US005630588A

United States Patent [19]

Gladish

[11] Patent Number: 5,630,588

[45] Date of Patent: May 20, 1997

[54] APPARATUS AND METHOD OF PLAYING A GAME USING AZIMUTHS

[76] Inventor: William C. Gladish, 2427 Windsor Village Dr., Miamisburg, Ohio 45342

[21] Appl. No.: 380,826

[22] Filed: Jan. 30, 1995

[51] Int. Cl.[6] ..... A63F 3/00

[52] U.S. Cl. ..... 273/265

[58] Field of Search ..... 273/265, 255, 273/262

[56] References Cited

U.S. PATENT DOCUMENTS 4,194,742 3/1980 Adams ..... 273/265

*Primary Examiner*—Benjamin H. Layno
*Attorney, Agent, or Firm*—Wascher & Thomas, PLLC; Rick R. Wascher; Laura K. Thomas

[57] ABSTRACT

A method and apparatus for teaching azimuths. The present invention discloses a game or simulation using azimuths to locate targets placed on the game board of a player's opponent. The player alternate turns in an attempt to hit the targets on the opposing player's board. The first player to hit all of the targets on the opposing player's board wins the game. The apparatus therefore includes at least one game board having a plurality of spaces, reference points from which azimuths can be selected, and a mechanism for determining which of the spaces is hit by the intersection of two azimuths from the preselected reference points. The method incorporates the use of the present inventive apparatus for play. Alternative game boards, azimuth mechanisms, and rules are also disclosed.

35 Claims, 19 Drawing Sheets

APPARATUS AND METHOD OF PLAYING A GAME USING AZIMUTHS

BACKGROUND OF THE INVENTION

1. Field of the Invention:

The present invention relates generally to games of strategy incorporating the ability of players to determine the intersections of azimuths.

2. Description of the Related Art:

The art to which the present invention relates includes strategic games or simulations. The well known games sold under the trademark BATTLESHIP partially comprises the art to which the invention relates. The BATTLESHIP game is a two player or two team game. Each player or team positions a plurality of ships on a grid space having horizontal and vertical intersecting coordinates. Each player or team takes turns selecting and calling out an identifiable position on the opposing player's or team's grid with the hopes of scoring a hit on one of the opponents ships placed on the grid. Thus, each time a ship or a portion thereof occupies a grid space which an opposing player calls off, the opposing player is deemed to score a hit on the ship and play continues until all of a player's or team's ships are sunk. A ship is sunk after a predetermined number of hits are scored on each respective ship.

For example, a ship resembling an aircraft carrier will encounter more hits to sink the ship, but an aircraft carrier is easier to locate on the grid because it occupies mere than one grid space. In comparison, a small PT-boat will take fewer hits to sink, but a PT-boat is more difficult to find, because it typically occupies only two grid spaces. Throughout play of the game BATTLESHIP, an opponent's playing board on which an opponent's ships are placed is hidden from view of the opposing player. Accordingly, the identifiable grid spaces called off during play of the BATTLESHIP game are, for the most part, chosen at random until the player scores a hit and attempts to score additional hits on the same ship in order to sink it.

Other games that comprise the art to which the invention relates include "Checkers" and "Chess". Checkers and Chess are played on a grid type board with a variety of playing pieces moved in patterned, or allowable, directions. With respect to the game of chess, certain playing pieces such as the bishop, queen and to some extent the rook are movable along lines of play that could be described as azimuths.

Typically, azimuths are associated with air and sea navigation and used extensively in the military for establishing a point to azimuth intersection relationship. An azimuth can be defined as a distance in angular degrees from a reference point. Using two reference points and using one azimuth from each point an azimuth intersection can occur. An azimuth may also be defined as an arc of the horizon measured between a fixed point (location of the observer) and the vertical circle passing through the center of an object (the intended target).

An azimuthal equidistant projection is, therefore, a map projection of the surface of the earth (or some other finite space having boundaries), so centered at any given point that a straight line radiating from the center to any other point represents the shortest distance and can be measured to scale, For example, if a map of a particular national forest is used, one can determine the location of a target by selecting two points of reference. The first point is a landmark having a known map position, and the second point is a different landmark having a known map position but not coincident with the first point. From there a first intersecting line can be drawn from the first point to the target, and a second line can be drawn from the second point to the target. The azimuth intersection of these lines provides a precise location of the target on the map.

Until now, a game or simulation utilizing an azimuthal selection based upon the intersection of two such intersecting azimuths from two reference points, and a hypothesis of the player selecting the intersecting azimuths from the two frames of reference to the target, has not been invented.

SUMMARY OF THE PRESENT INVENTION

The game or simulation incorporates selecting spaces where the azimuths intersect. If an opponent ship were to occupy one of the spaces where the azimuths intersect and the opposing player were able to designate from which of the three fixed reference points he/she should select and target the opponent's ship, he/she will then select an azimuth from two of the three reference points in the hopes that the intersection corresponds to the space which his/her opponent's ship occupies.

The present invention can be summarized in a variety of ways, one of which is the following: A game or simulation, comprising: at least one game board having a grid, having a plurality of columns and a plurality of rows, defining a plurality of spaces, and a plurality of reference points; at least one playing piece configured to be positioned on the game board and occupy at least one of the spaces; and azimuth means for determining azimuth intersections and the location of at least one space occupied by the at least one playing piece.

The game apparatus may also include two identical grids, each grid may be positioned on a separate game board having indicia enabling a player of the game to identify the position and location of a space positioned within the grid of the game board, an encoder which turns a players azimuth selections into a card indicia, a plurality of decoder cards each having the location of a space corresponding to a space on the grid of the game board, and having indicia corresponding to the indicia of the encoder, and an optional protractor means to help visualize the azimuths of the space occupied by the at least one playing piece. The present inventive apparatus may also include a space locator means for randomly identifying any of the plurality of spaces on the game board, an instruction set defining at least one method of playing the game, a plurality of playing pieces.

The game board may also include vertical indicia associated with the columns and horizontal indicia associated with the rows of the grid to provide addresses for the plurality of spaces on the grid of the game board, and the plurality of reference points may be fixed with respect to the grid of the game board, or positioned by a player of the game, such that the reference points may be separated by at least one of the plurality of spaces. To facilitate play with the inventive apparatus, the invention also includes an instruction set having an instruction requiring the placement of the plurality of reference points on the grid of the game board separated by at least one of the plurality of spaces.

The present inventive method may be summarized in a variety of ways, one of which is the following: a method of playing a game using azimuths to locate any of a plurality of spaces contained within a grid of a game board, comprising the steps of: providing at least one game board; providing at least one playing piece; providing a plurality of reference points to the game board; positioning the at least one playing piece on the grid of the game board; selecting a first azimuth emanating from one of the plurality of reference points; selecting a second azimuth to intersect with the first azimuth, wherein the second azimuth emanates from another of the plurality of reference points different than the reference point from which the first azimuth emanates; determining the point of intersection of the azimuths; identifying the location of the space contained within the grid of the game board that has the intersection of the azimuths.

The step of selecting the first azimuth may also include providing a protractor to assist the player in determining the first or second azimuths. A spinner or computer may be included to randomly position the playing piece on the grid of the game board prior to the start of the game.

The method may also include providing a plurality of target playing pieces and providing a plurality of playing pieces for marking the point of intersection of the first and second azimuths. The method may also include selecting a third azimuth in the vertical plane to find the elevation of suspended targets.

DETAILED DESCRIPTION OF THE PREFERRED EMBODIMENT

Figure 1:
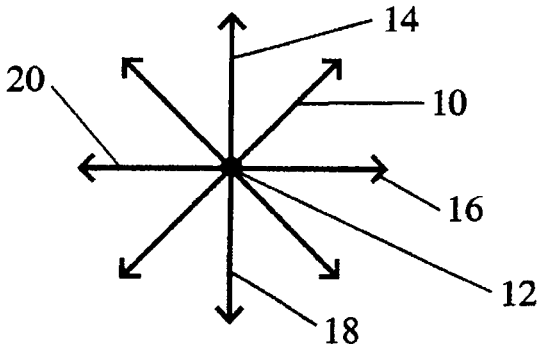
FIG. 1 is a representative illustration of several azimuths or radials projecting from a reference point.
Figure 2:
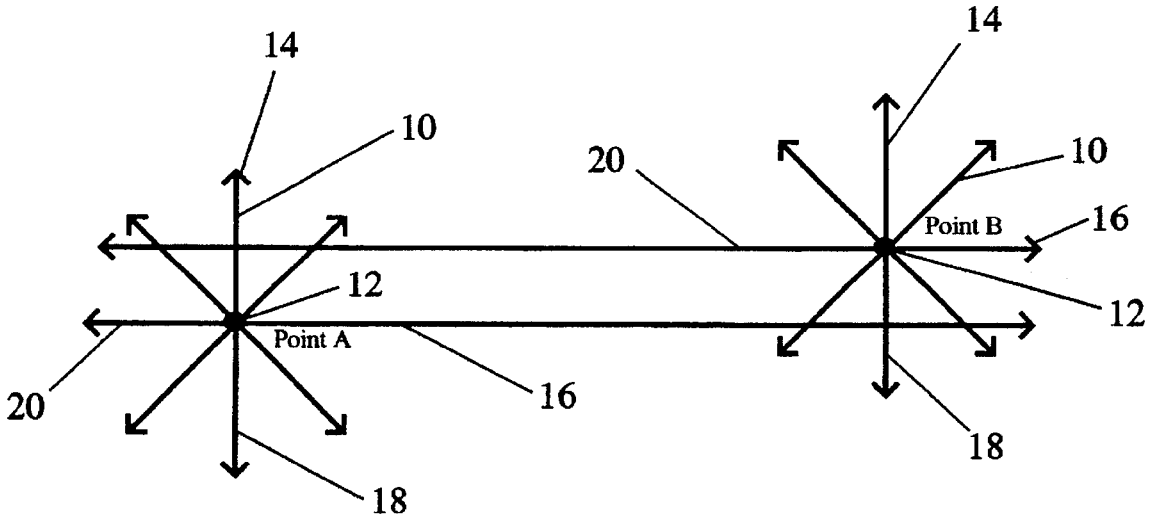
FIG. 2 is a representation of several azimuths or radials projecting from two reference points and further illustrating the points of intersection between a plurality of azimuths associated with each of the reference points.

With reference to FIGS. 1 and 2, azimuths or radials (hereinafter simply "azimuth(s)") are visible as emanating anisotropically in two dimensions from the reference points in those figures. Azimuths, designated generally by the reference numeral 10, project radially from fixed reference points 12. Azimuths 14, 16, 18 and 20 correspond to 0 (or 360) degrees, 90 degrees, 180 degrees and 270 degrees.

Figure 3A:
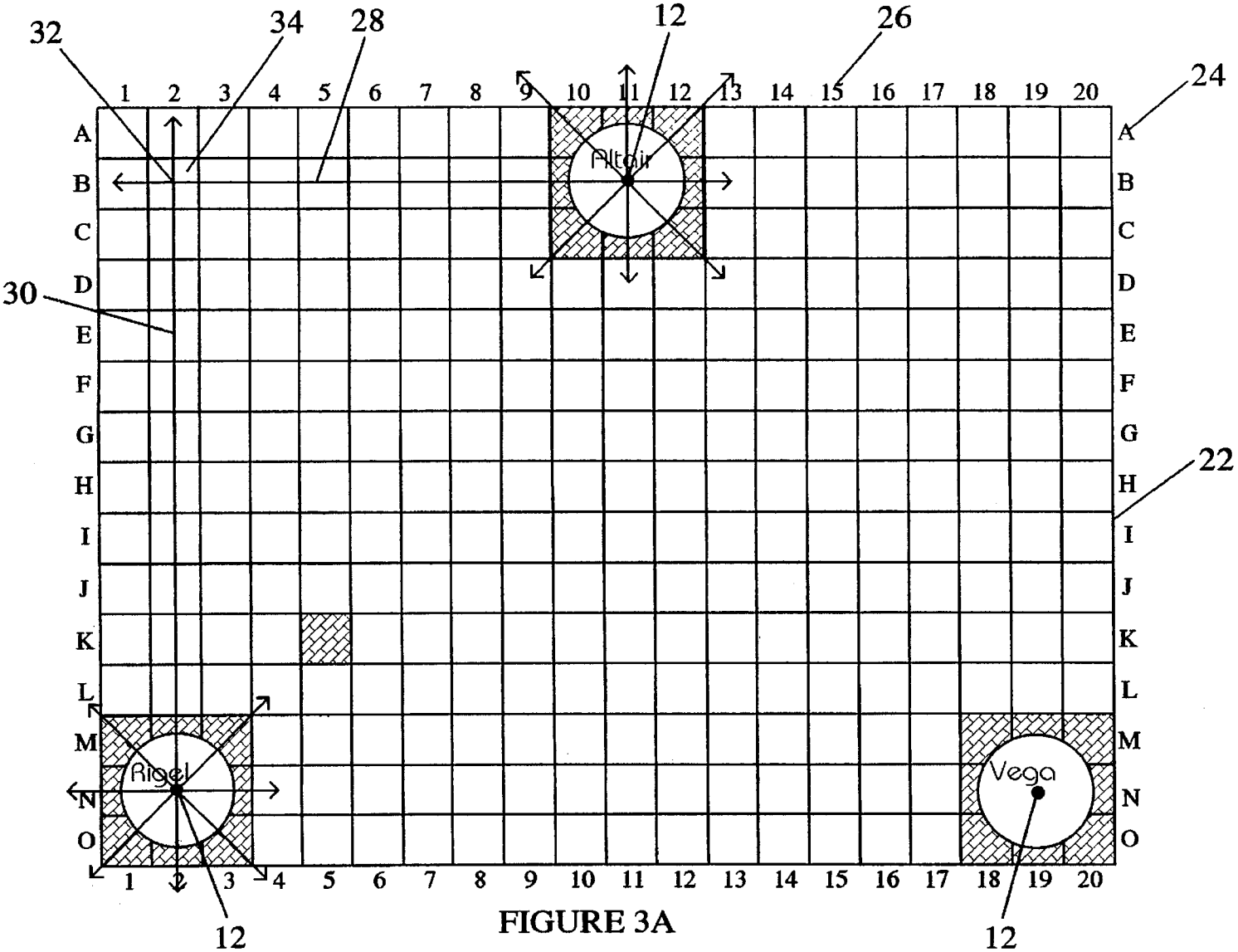
FIGS. 3A and 3B are elevated views of two alternate embodiments of a game board of the present invention each illustrating reference points.
Figure 3B:
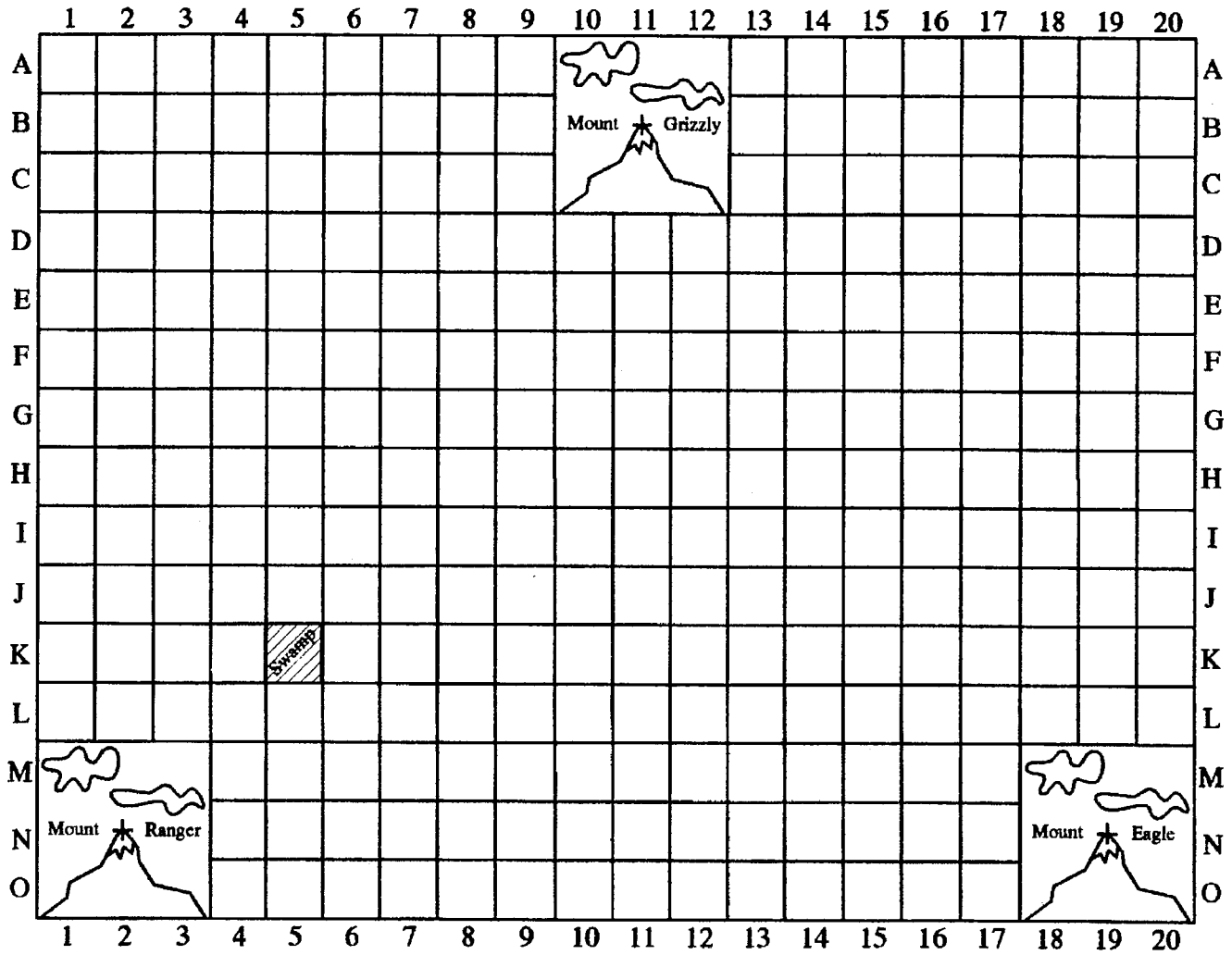

With reference to FIGS. 3A and 3B, two preferred embodiments of the game board of the present invention are shown. As will be described hereinbelow, two of the three reference points 12 have azimuths, like those shown in FIG. 1, emanating therefrom. Reference points 12 are positioned on a grid 22. The horizontal rows have letter indicia 24 and vertical columns have numerical indicia 26 associated therewith in a manner similar to a conventional map. The intersection of a particular letter and number correspond and identify the location of a specified grid space.

The names "Altair", "Vega" and "Rigel" (FIG. 3A), and "Mount Grizzly", "Mount Ranger" and "Mount Eagle" (FIG. 3B) have been chosen arbitrarily and are simply selected to add to the appeal of the inventive game and its description set forth herein and are not believed to be limiting as to the scope of the present invention.

Accordingly, when using azimuths in conjunction with the game boards of FIGS. 3A and 3B to identify a grid space, one need only select an azimuth measured in degrees from two of the three reference points (reference to the description for FIG. 1 may be helpful) and determine their point of intersection to identify the location and position of the grid space. For example, with reference to FIG. 3A, if an azimuth 28 is selected from Altair 12 corresponding to 270 degrees and an azimuth 30 from Rigel 12 corresponding to 0 or 360 degrees, the intersection of the two azimuths 28 and 30 is at a point 32. This intersection also corresponds to grid space B-2, designated generally by the reference numeral 34. Accordingly, if an opponent were to place a target such as a ship 50 (see FIG. 8A and the corresponding description set forth below) on his own game board at B-2 during play, the opposing player may simply select 270 degrees Altair and 0 degrees (or 360 degrees) Rigel.

Figure 3C:
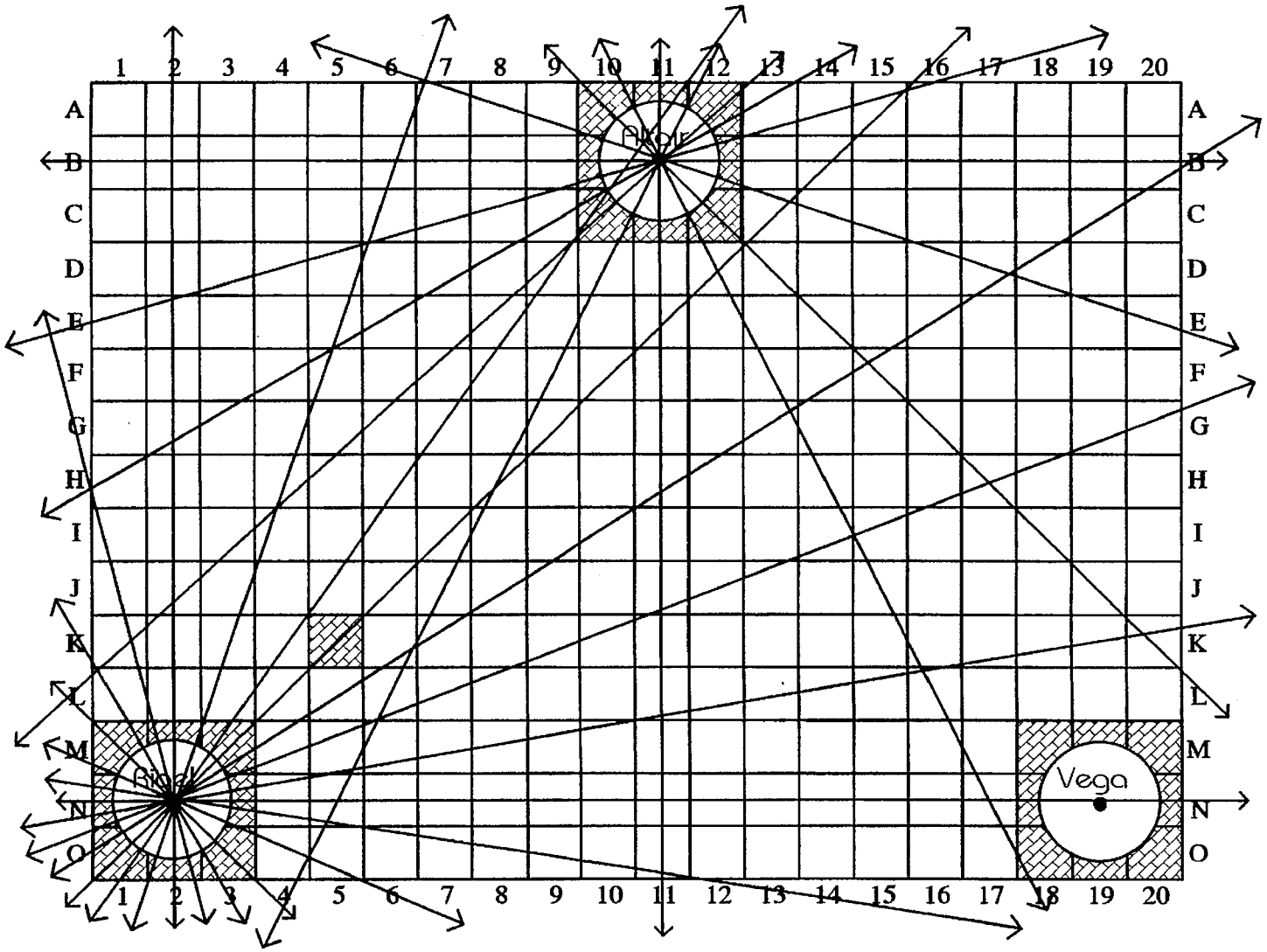
FIGS. 3C and 3D are elevated views of the game board shown in FIG. 3A incorporating a plurality of azimuths drawn from two of the fixed reference points of FIG. 3A.
Figure 3D:
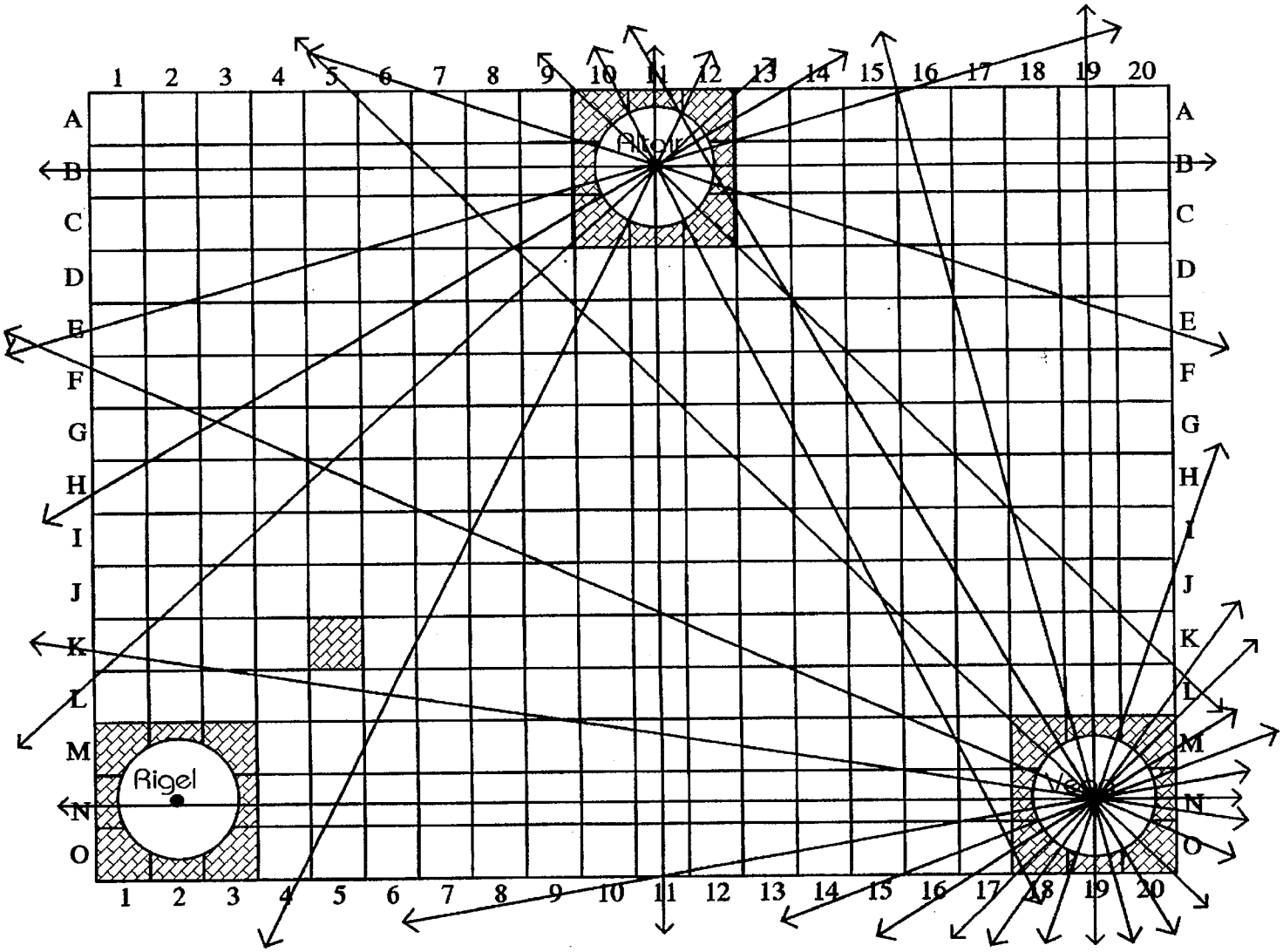

With reference to FIG. 3C and 3D, a plurality of azimuths are drawr from two of the fixed reference points in order to better illustrate other, more complex, example of selecting azimuths having the desired or appropriate intersection points.

Figure 4:
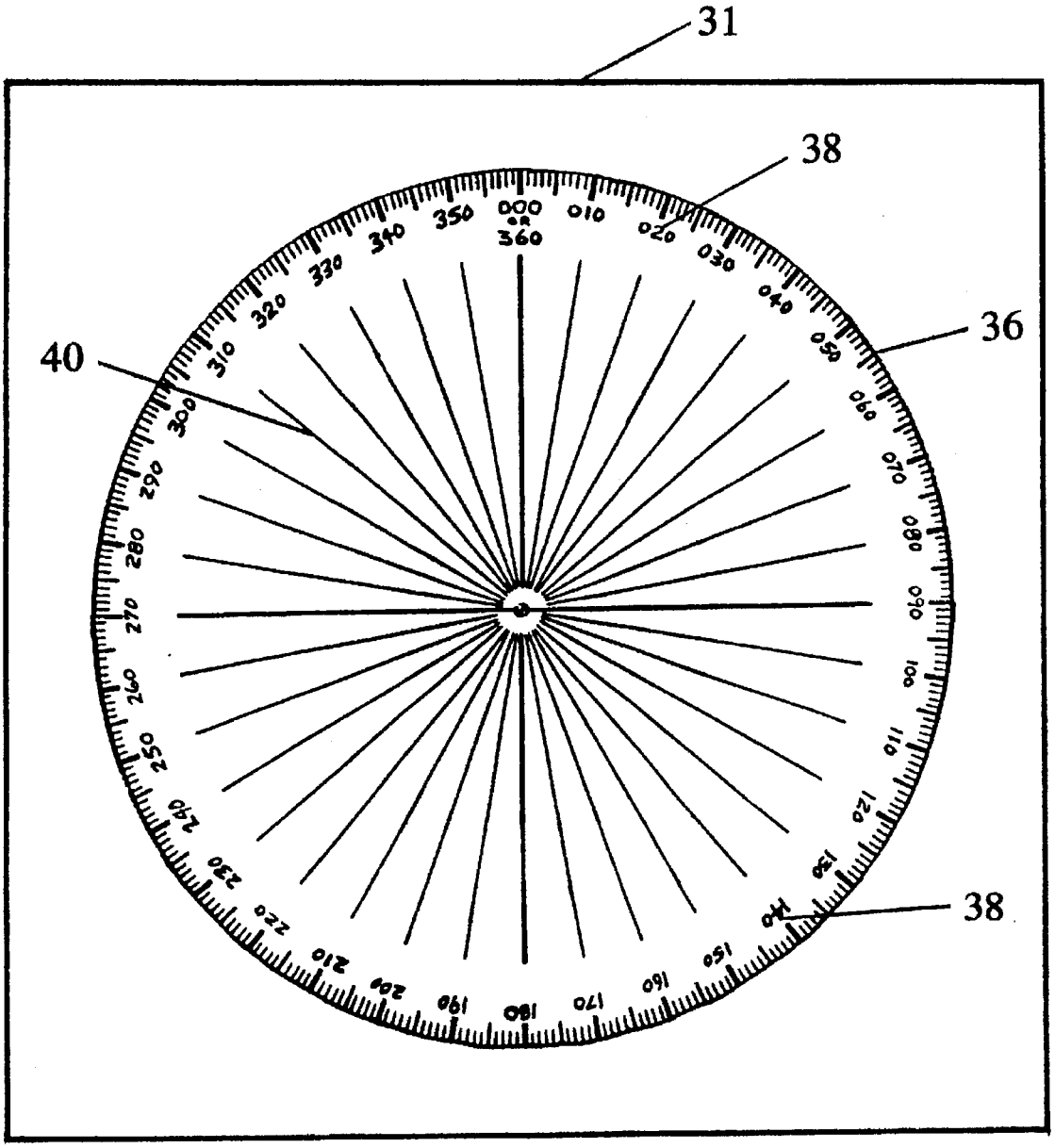
FIG. 4 is an elevated view of an optional protractor used in conjunction with the present invention.

With reference to FIG. 4, an azimuth protractor designated generally by the reference numeral 31 may also be provided and used as an optional playing aid, because some players may experience difficulty in selecting an appropriate azimuth without the additional visual aid of the protractor 31. The protractor comprises a circular disc 36 with indicia 38 in the form of degrees marked thereon. Azimuth indicator lines 40 are provided for visual approximation of the player selected azimuth.

Figure 5:
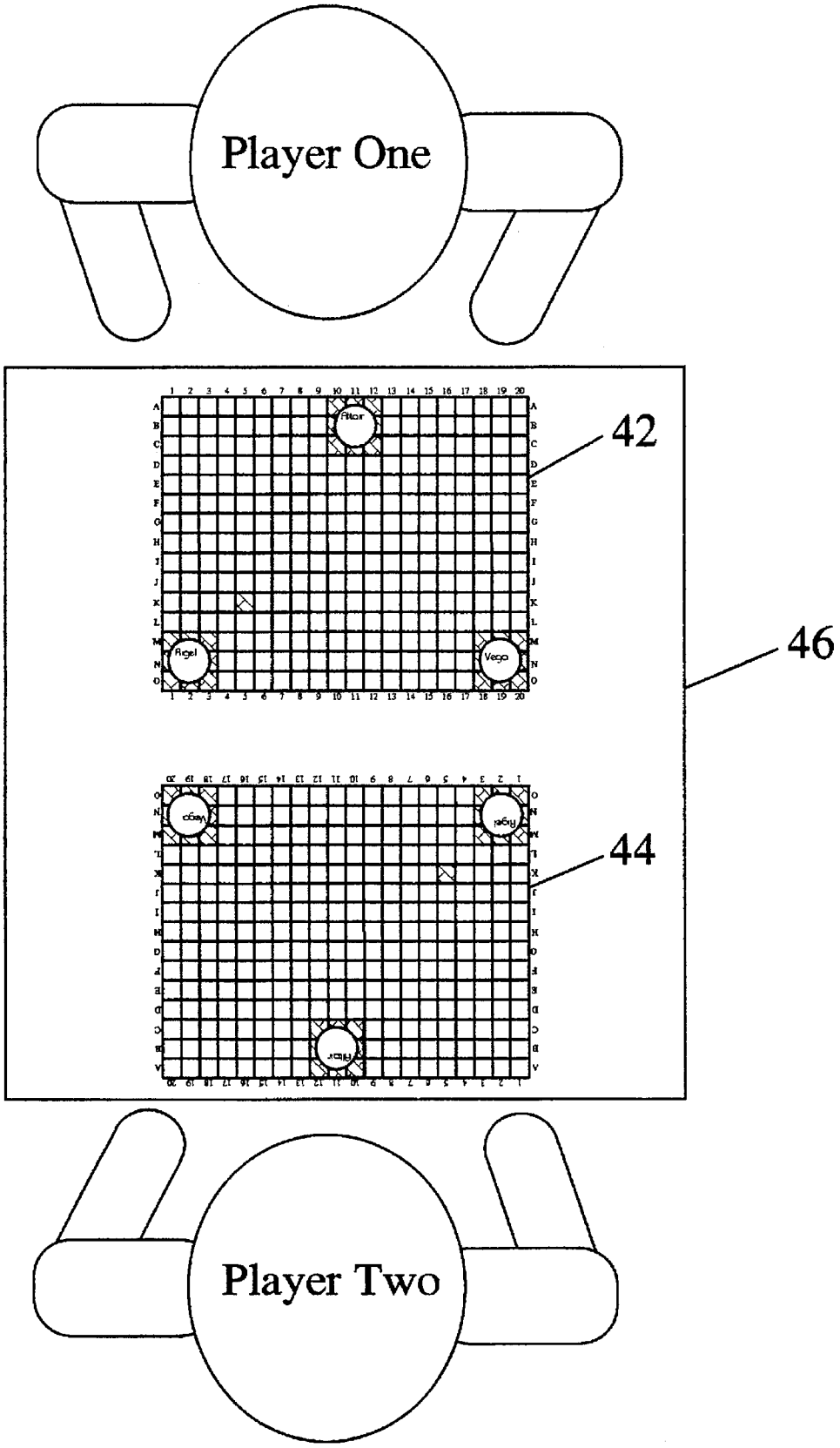
FIG. 5 is a representational view of the game of the present invention being played by opposing players illustrating the relative alignment of the players and their respective game boards.

In one embodiment of the invention, the azimuth protractor can be formed of a clear plastic so that it can be placed over the playing board grids shown in FIGS. 3A and 3B. With respect to FIG. 5, illustrating one exemplary alignment of the opposing games boards used during play, player 1 and player 2 are positioned as indicated. Two identical game boards 42 and 44 are positioned on the playing surface 46. Accordingly, protractor 31 may be placed on one of the game boards 42 and 44, and used to better enable a player to make a hypothesis as to the desired anti correct azimuth from a fixed point of reference. In the preferred embodiment, however, the azimuth protractor 31 is not used and the azimuths are determined by an approximation or guess of the player.

Figure 6:
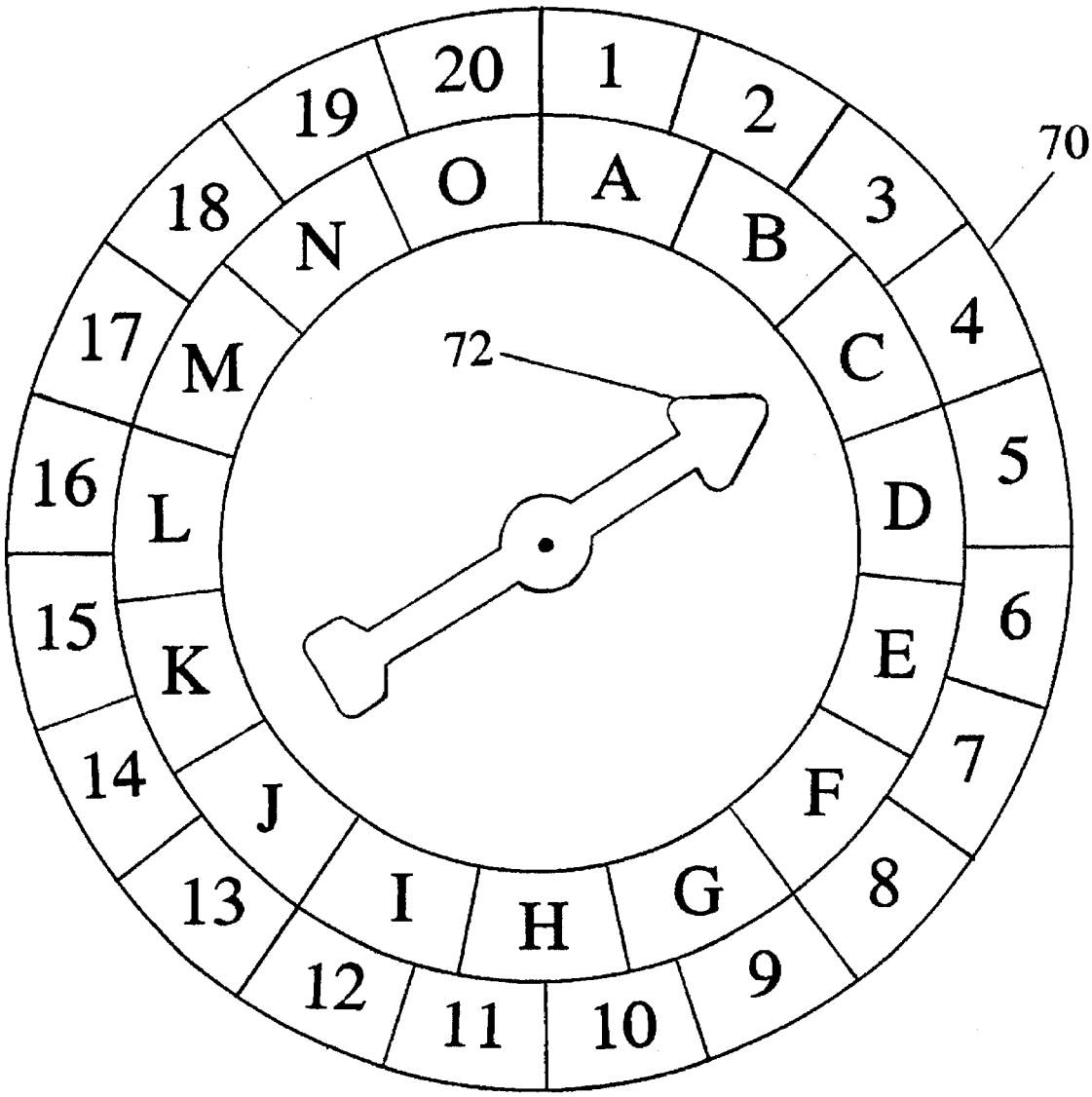
FIG. 6 is a top view of an embodiment of the optional spinner which may be used in conjunction with the present invention.

With reference to FIG. 6, an optional spinner of the inventive game is designated generally by reference numeral 70. Spinner 70 may be utilized to randomly place playing pieces 50 on the game board before play begins. That is, a player may take two spins of the spinner needle 72 of the spinner 70. The first (or the second) spin will generate a letter (or number) and the second of the spins may generate a number (or letter) as the case situation may dictate. From the combination of the letter and number corresponding to a grid space in the manner described above, the player positions the playing piece 50 on the corresponding grid space.

The inventive game therefore includes at least one game board 48 having a boundary, a plurality of playing pieces 50 (FIGS. 8A and 8B), an optional azimuth protractor 31 and spinner 70. The game may also be played with a straight edge (not shown) to assist the player with reading the encoder.

Figure 7A:
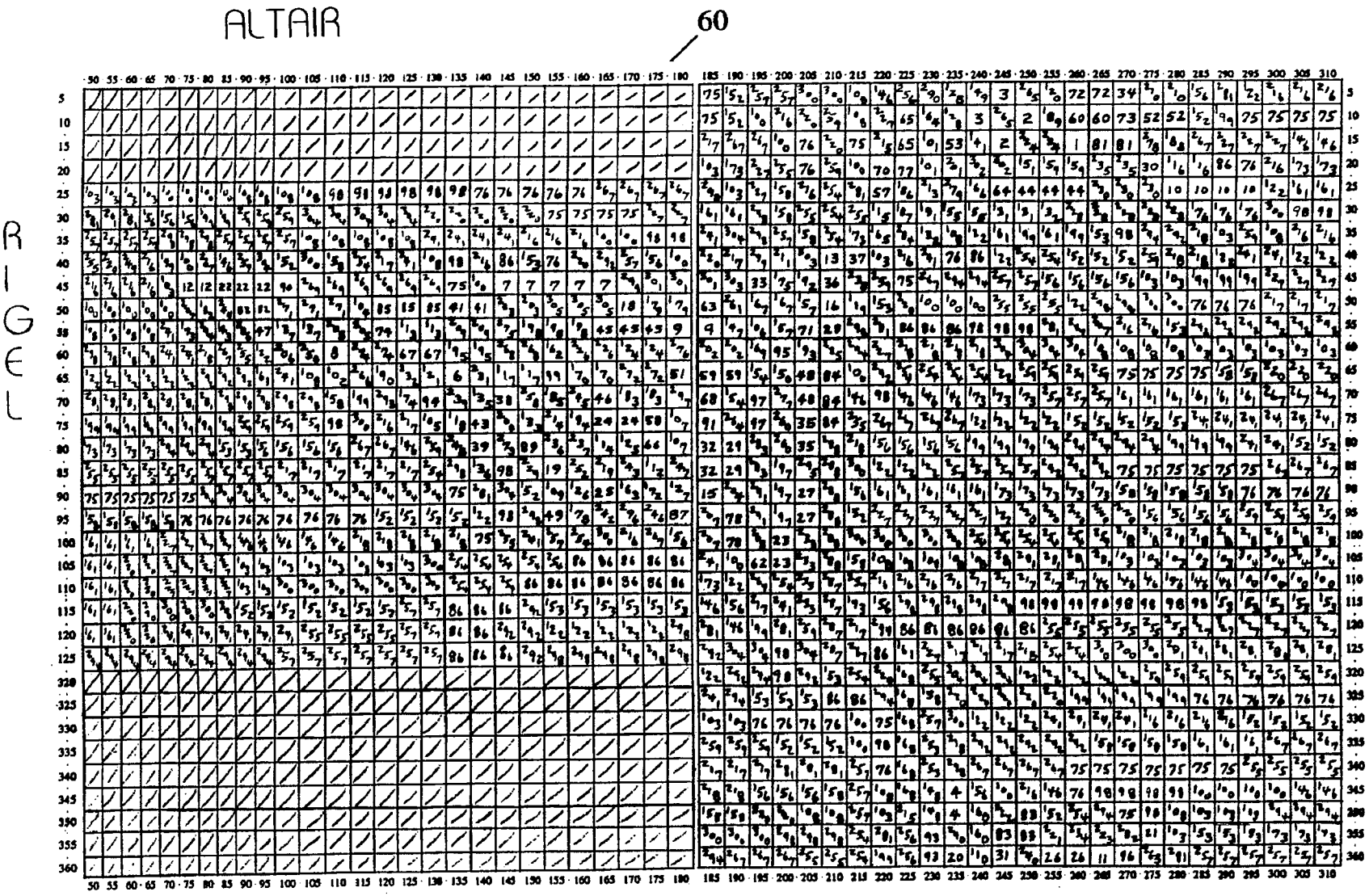
FIGS. 7A and 7B are top plan views of an embodiment of the encoder of the present invention.
Figure 7B:
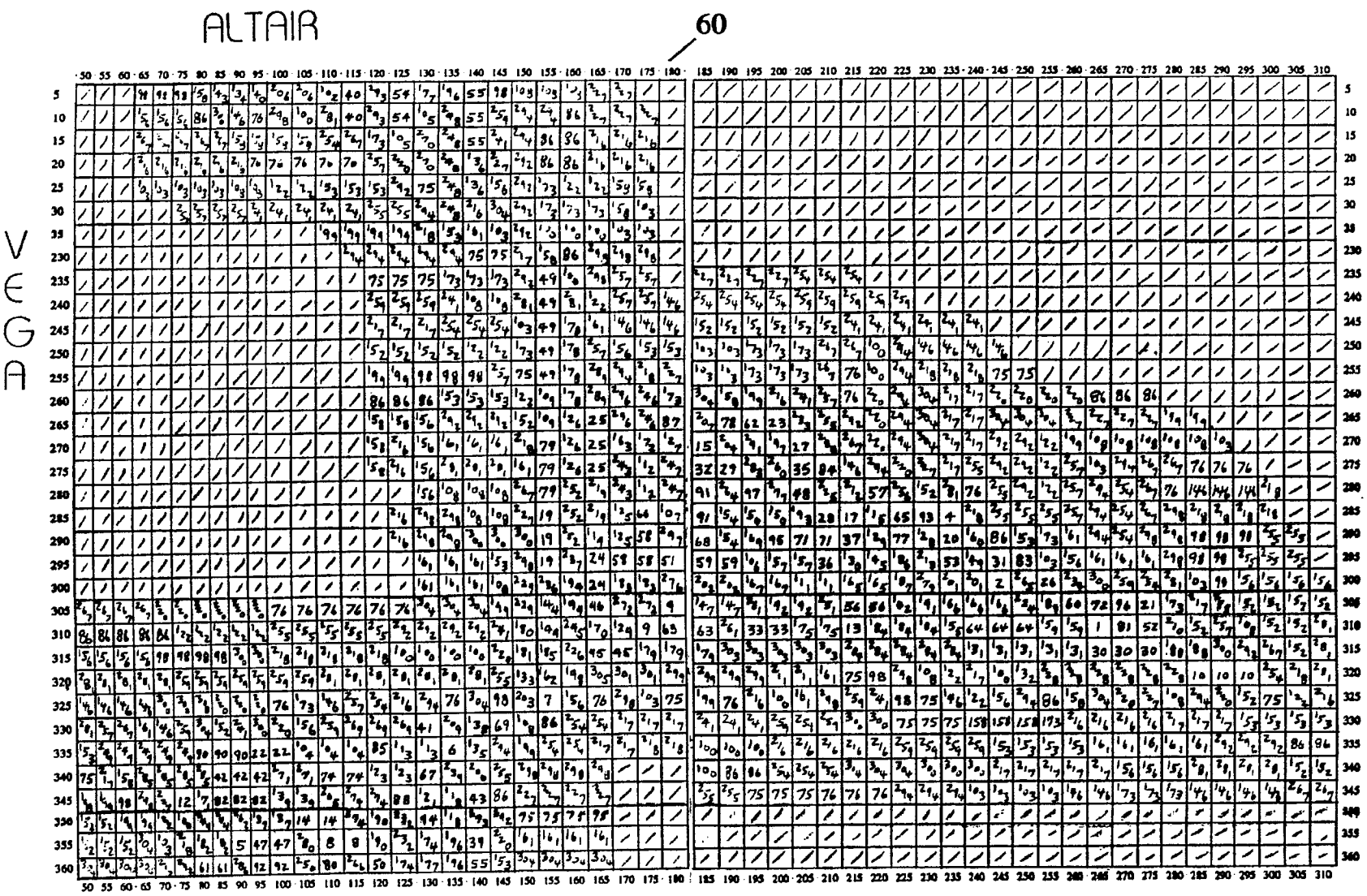
Figure 7C:
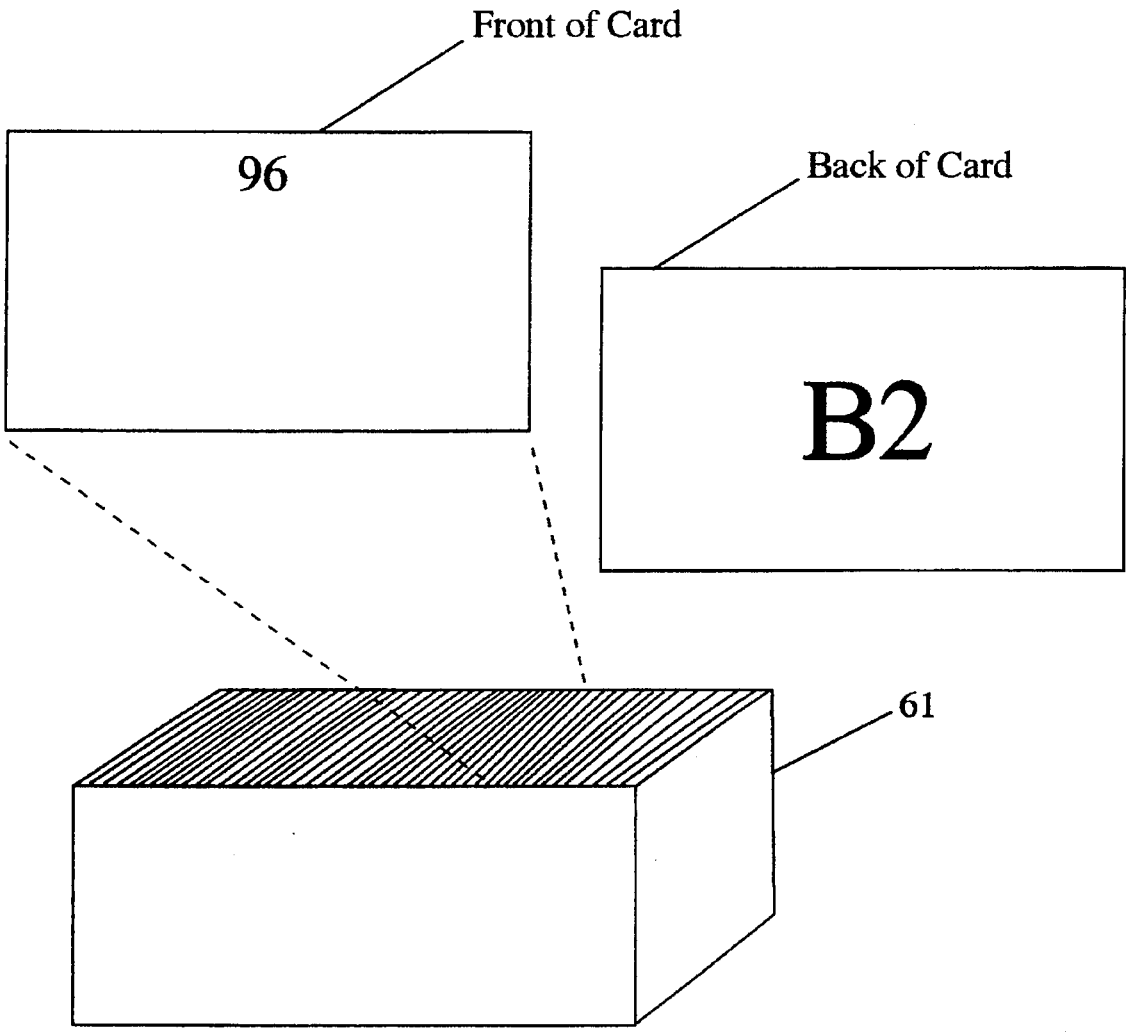
FIG. 7C is a representative illustration showing a deck of decoder cards and the front and back of a decoder card.

With reference to FIGS. 7A and 7B, the encoder can comprise a table 60. The player selects a pair of azimuths and references table 60 and determines a decoder card number. With reference to FIG. 7C, the decoder can comprise a deck of cards 61, the corresponding card reveals the grid space designated by letter and number. For example, each of the cards may have a front and a back. The front will include a number and the back a number and a letter. The number corresponds to the card number in relation to the other cards in the complete deck and the encoder, and the back will include the grid location of the space associated with the intersecting azimuths selected by the player. Using the Altair 270 degree and Rigel 360 degree example, a player will use the encoder (FIG. 7A) to determine that card number 96 will reveal the grid which the two azimuths intersect (FIGS. 7C and 3A).

Figure 8A:
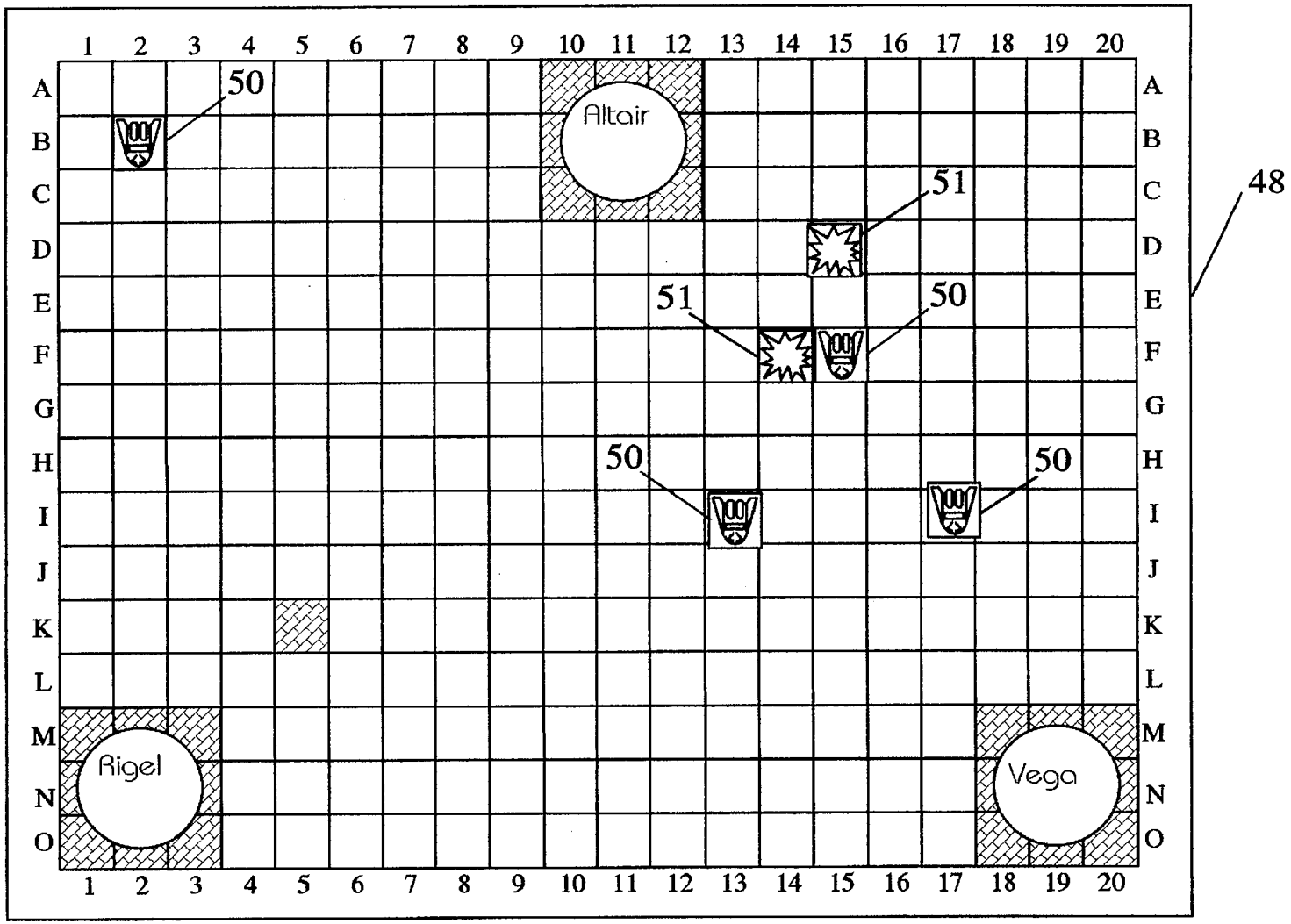
FIGS. 8A and 8B are top views of the game boards of FIGS. 3A and 3B shown with a plurality of playing pieces positioned on the game boards, respectively.
Figure 8B:
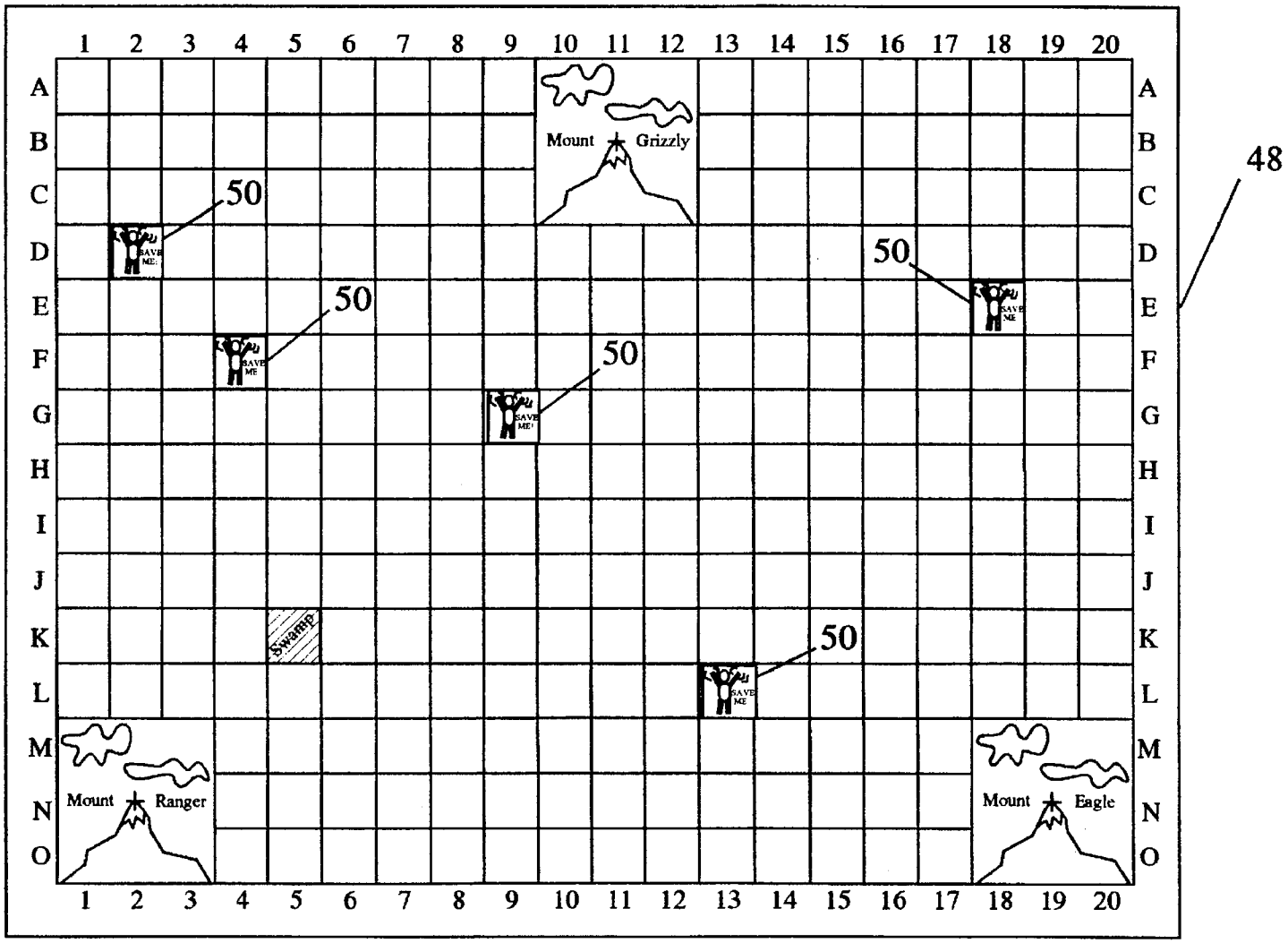

Incorporating the encoder and decoder deck of corresponding cards having grid space locations easily mapped thereon by letter and number, the game is provided with an element of security in an attempt to eliminate any unfair calculation of azimuth intersections and their corresponding grid space. That is, for any two of the three reference points (see FIG. 3C for an example), the encoder designates the card having the grid space identified by letter and number corresponding to the game board or map location of the grid space as it relates to the point of intersection of the selected azimuths. With reference to FIG. 8A, blast playing pieces 51 may be put on the game board where the intersection of azimuths occur.

MODE OF OPERATION

The mode of operation shall be described with respect to the embodiment of the game board shown in FIG. 3A, but other games boards having other suitable layouts and designs may also be used without deviating from the scope of this exemplary mode of operation. Similarly, the mode of operation described herein is solely for illustration purposes and to facilitate a better understanding of the game. Other modified methods of play may be devised by the players and all such methods are incorporated herein as being contemplated by the disclosure submitted and set forth.

Accordingly, in use the players position their targets (e.g., ships, etc.) anywhere on their own game board. The player to play first is selected and he, looking at the opposing player's game board with its ships placed thereon, selects an azimuth from a first reference, Altair (FIG. 3A), and an azimuth from a second reference point other than the reference selected for the first azimuth. In this fashion, the user selects the azimuth in hopes that their intersection will occur on the grid space occupied by one of the opposing player's ships.

If the point of intersection is determined not to occur where an opposing player's ship is located, the opposing player places a blast or other mark on the grid space where the intersection occurred in order to designate a missed attempt and to further enable the player to focus his attention on modifying the azimuths selected so as to account for the error. In this fashion, there are several embodiments of the method of play.

The blast may be treated as a mine which causes the grid spaces around the blast to be dead zones and prevent a player from entering the surrounding squares without having his or her ship destroyed. Of course, inherent with this embodiment of the method of play is the player's ability to move his or her ships prior to a subsequent turn by his opponent. In addition, a blast may be treated as a shelter behind which various player's ships may hide from a specified reference point of attack.

Therefore, in the event the first player misses a ship of the opposing player, the opposing player may move his or her ship any preselected number of spaces away from the last blast in order to further confuse the player who fired the last shot resulting in a missed attempt. Of course, elements of strategy dictate that a player may be attempting to lay a mine field or drive his opponent in a particular direction to a more easily identified grid location.

The second player then takes his or her turn, in much the same fashion as the first player, in an attempt to destroy all of the opposing player's targets (e.g., ships, etc.). Variations on the rules of play may include movement of ships, restricted zones for a different class of vessels, and a timed game. In addition to the three fixed reference points and ships occupying the spaces, "Nova stars" may be placed on the grid such that after a predetermined period of time a star explodes and any ship within one grid space of the star is destroyed. In this fashion, the user must also watch the timer in order to avoid such super Nova activity.

Figure 9A:
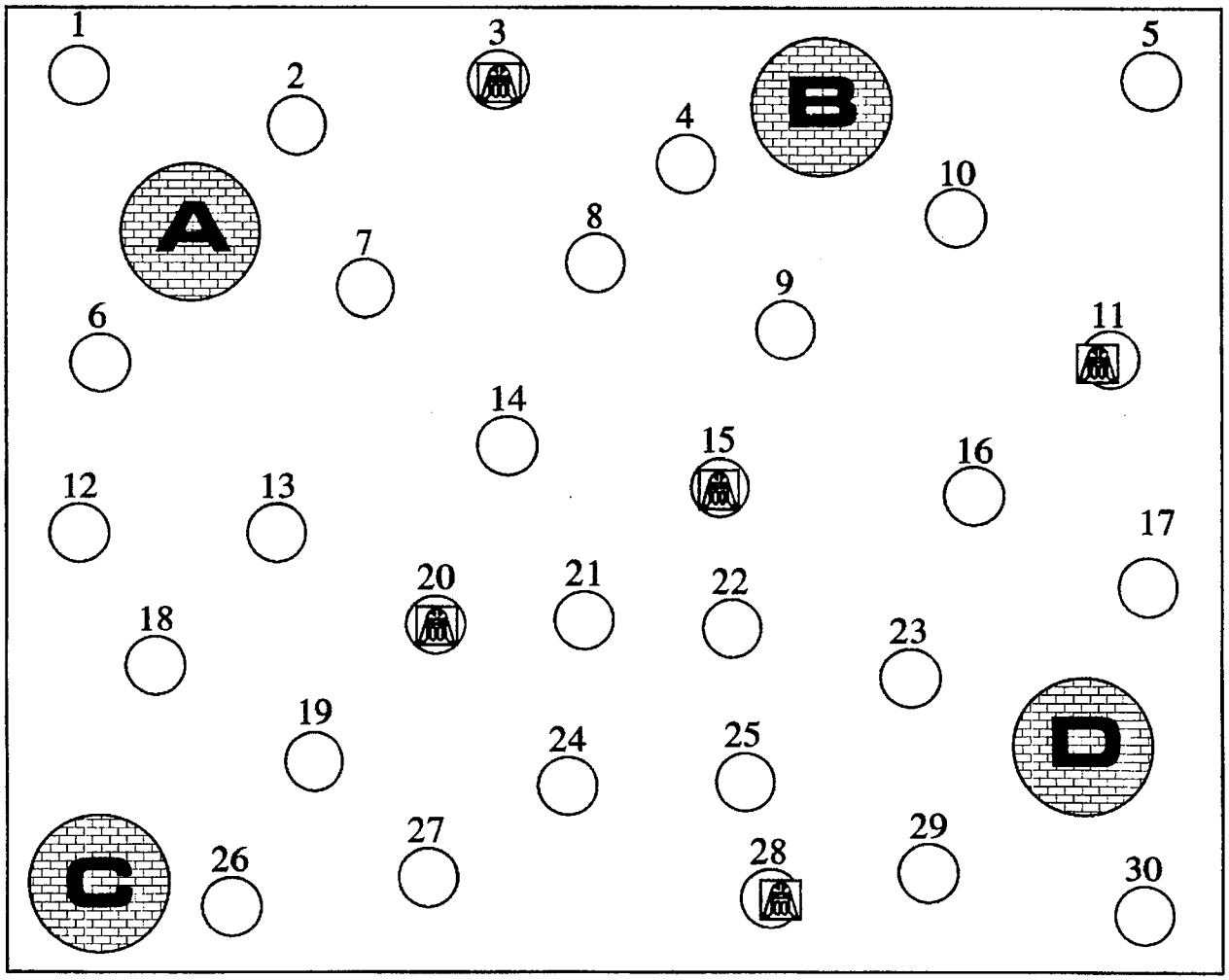
FIGS. 9A and 9B illustrate alternate embodiments of the game board component of the present invention shown without a grid necessary for play.
Figure 9B:
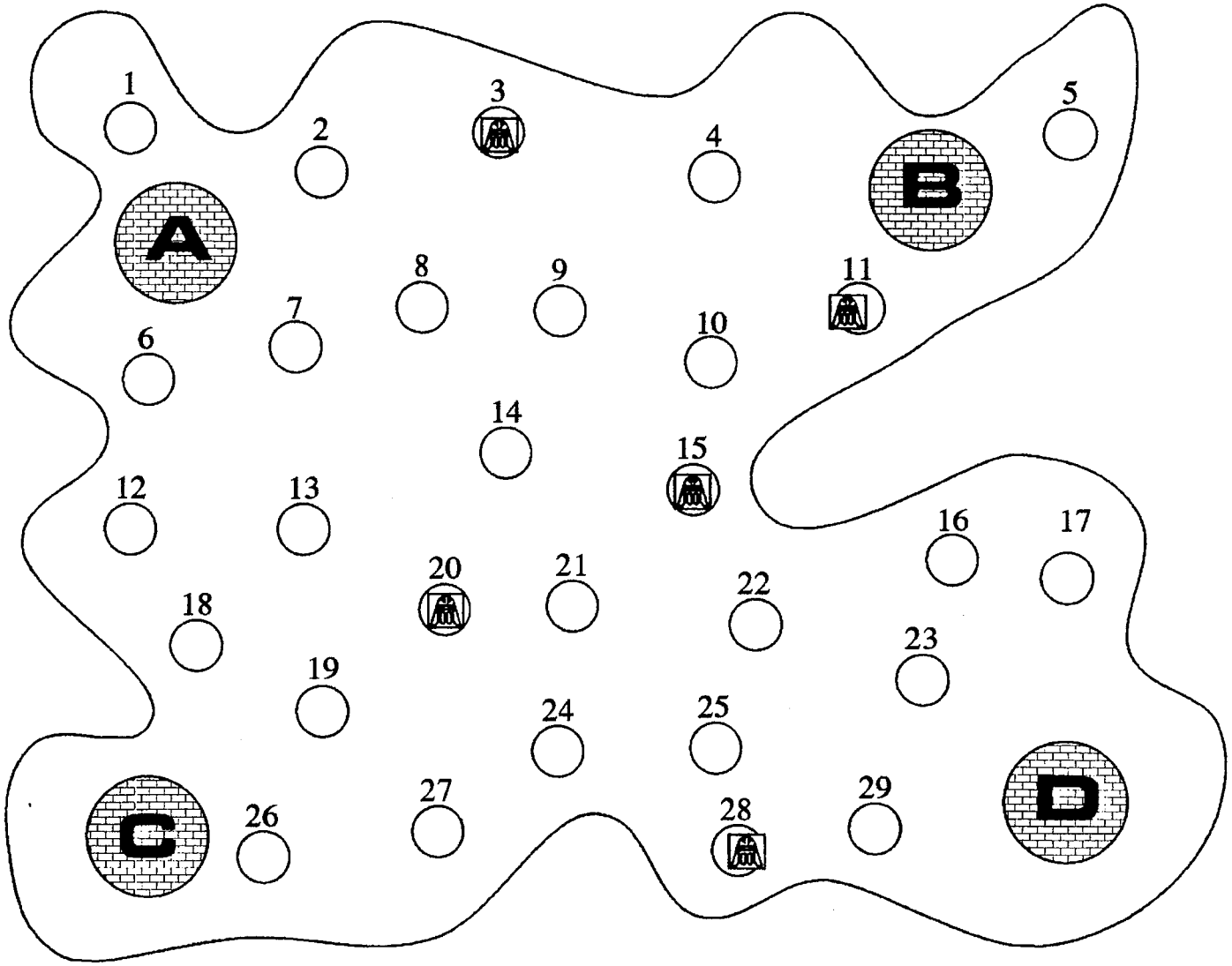
Figure 9C:
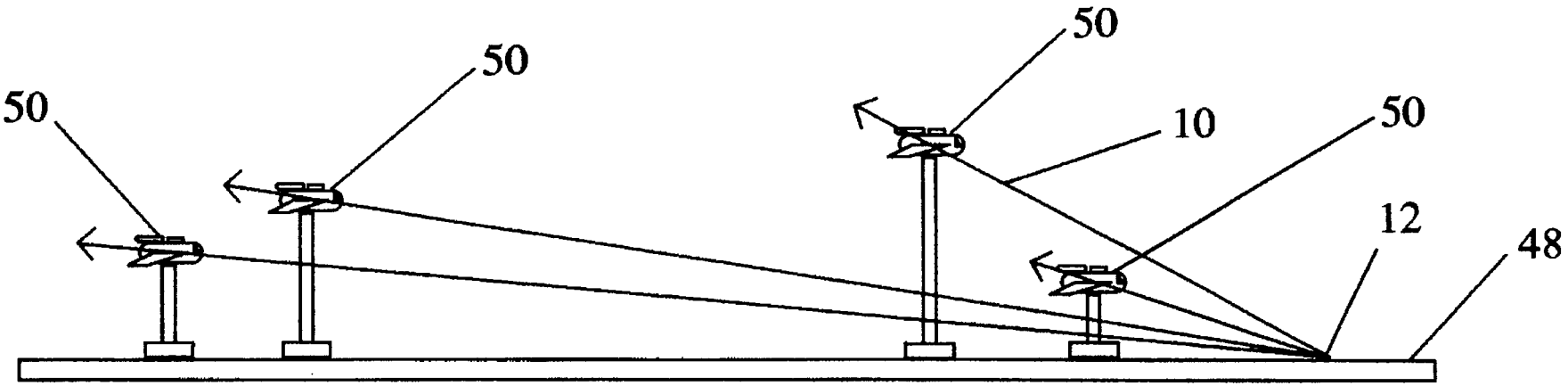
FIG. 9C is a side view of a game board with suspended targets and their associated elevation azimuths.

With reference to FIGS. 9A and 9B the game board component of the invention may be of any suitable shape and have reference points, spaces, and targets placed or drawn thereon. The player simply selects two of the reference points and attempt to formulate an intersection of azimuths drawn from the two reference points selected in order to hit the desired target with the azimuthal intersection in much the same manner as described above. With reference to FIG. 9C a third azimuth may be selected to find the elevation of suspended targets.

Figure 10A:
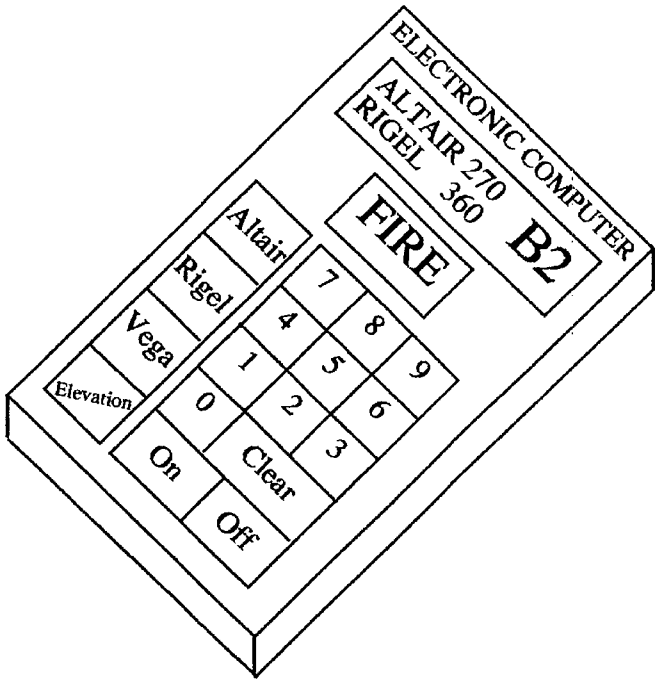
FIGS. 10A and 10B illustrate alternate embodiments of the game incorporating a software driven or computer game version.
Figure 10A:
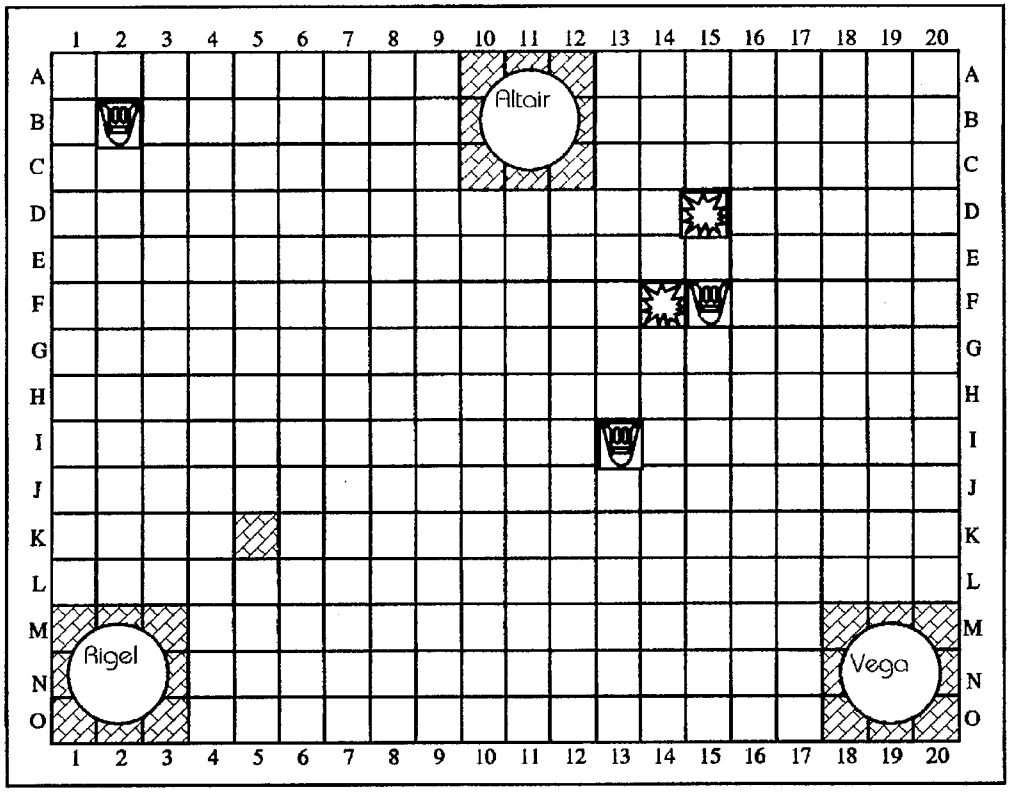
Figure 10B:
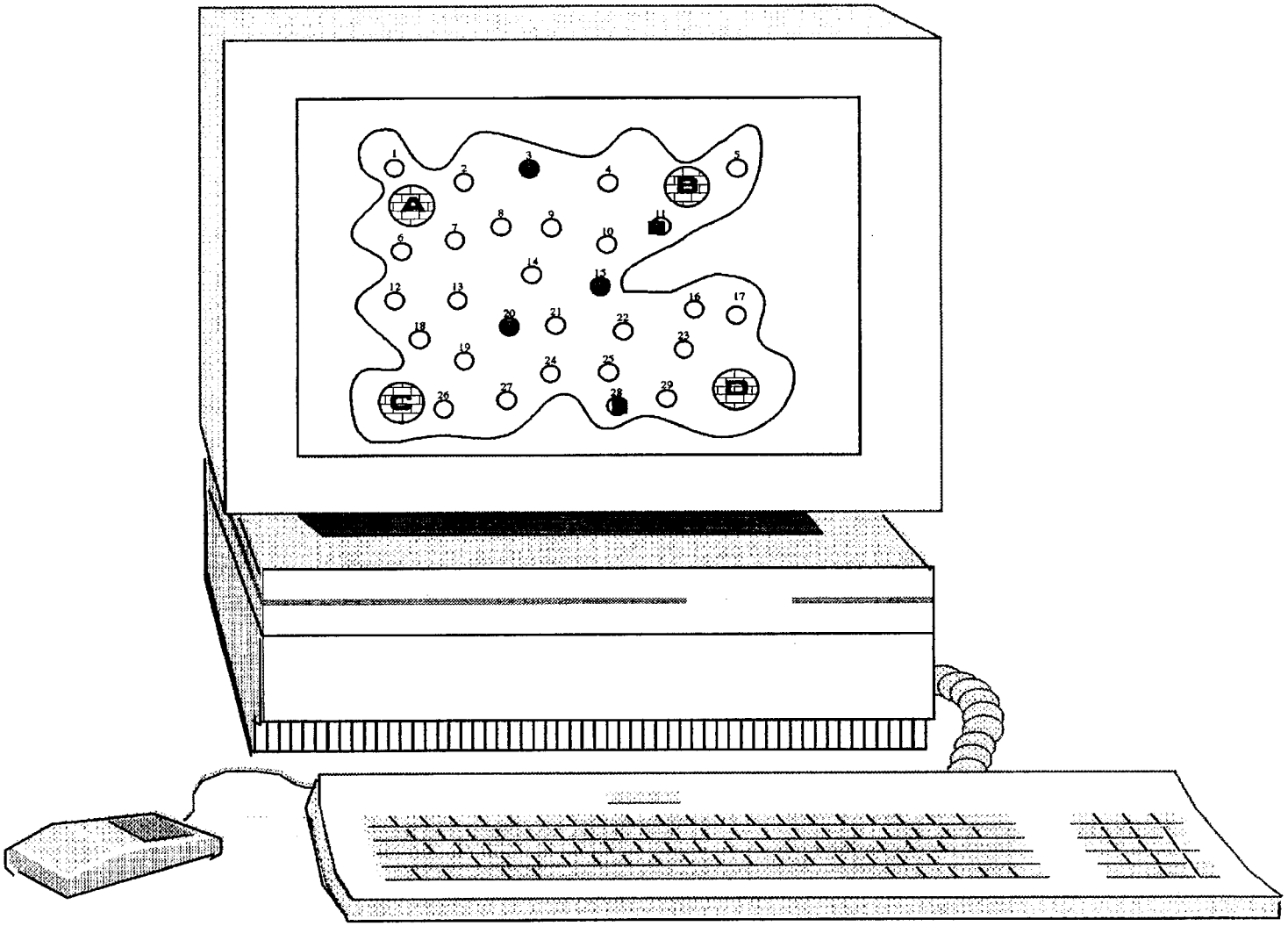

With reference to FIGS. 10A and 10B, still other embodiments of the present invention are directed to a software driven or computer game version of the invention. The software programming of this embodiment enables the player to enter their azimuth selection and the programming calculates the actual azimuthal intersection and displays the point of intersection providing the player with an automated visual determination of their relative success at trying to hit the player selected target.

Figure 11:
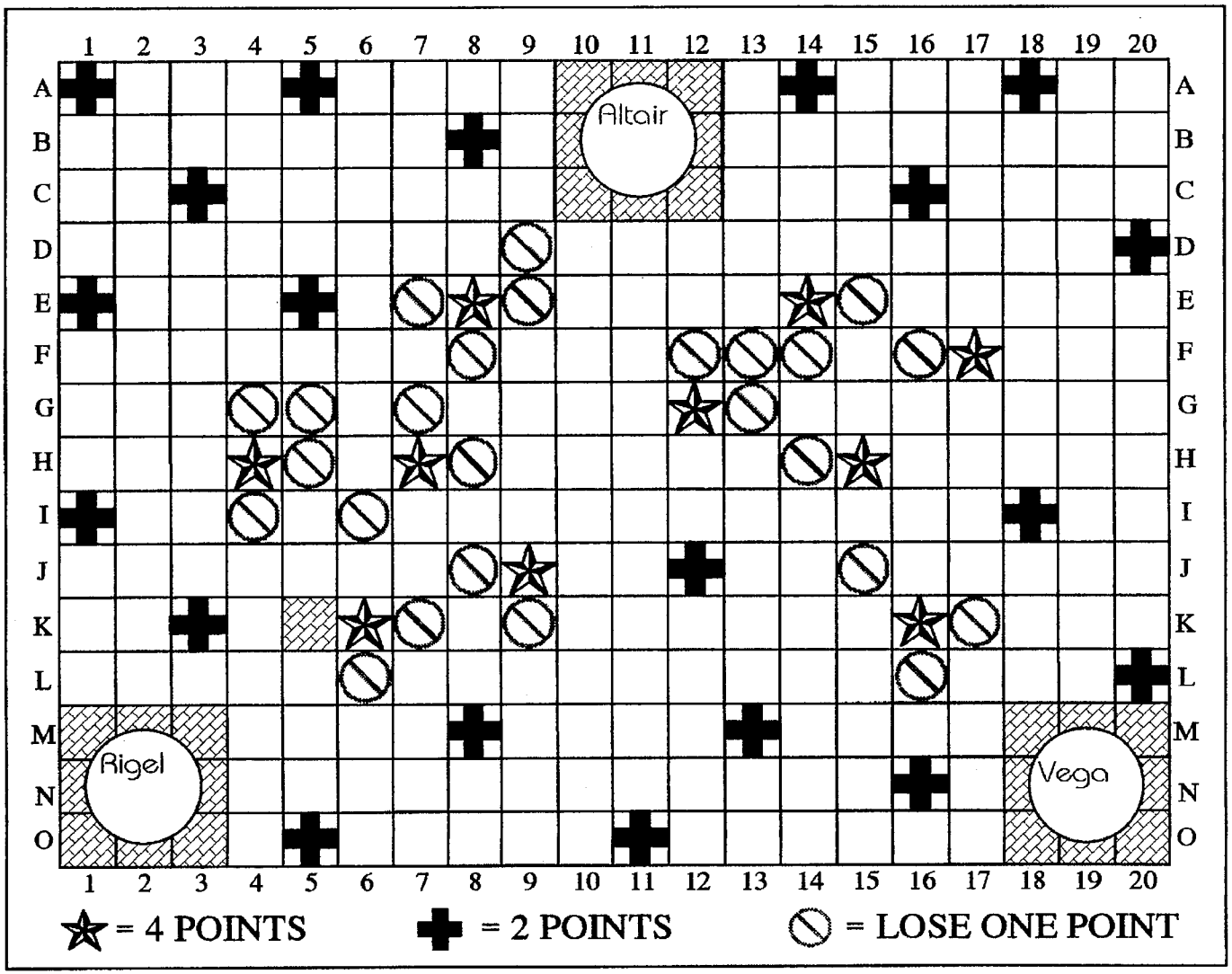
FIG. 11 illustrates an alternate embodiment of the game board which eliminates the need for movable playing pieces.

In still other embodiments the movable playing pieces can be eliminated in favor of fixed target points (FIG. 11), but the manner of play is essentially the same as that described above.

All of the foregoing embodiments are exemplary and are provided simply as a means of illustration and are not to be construed as limiting in any way. Accordingly, other embodiments and equivalents of the invention disclosed herein are contemplated, and the scope of the present invention is solely limited by the scope of the appended claims.

What is claimed is:

1. An instructional apparatus for teaching azimuths, comprising:

at least one viewing area means for displaying a plurality of spaces and a plurality of reference points;

azimuth indicator lines for use in selecting an azimuth;

means for determining a space location from two azimuths which intersect within the viewing the area means selected from a first azimuth emanating from a reference point at any orientation in angular degrees, from zero to three hundred sixty degrees, and a second azimuth emanating from a second reference point at any orientation in angular degrees, from zero to three hundred sixty degrees.

said means for determining a space location comprising an encoder and decoder system having first indicia corresponding to each of said plurality of reference points and to a plurality of angular degrees from zero to three hundred sixty degrees emanating from each of said reference points, wherein said first indicia corresponds to said point of intersection of two azimuths said encoder and decoder system further having a second indicia corresponding to said plurality of spaces on said viewing area means, and a third indicia for converting the location of said point of intersection from said first indicia to said second indicia; and instructional means for teaching the player how to operate said apparatus.

2. The apparatus of claim 1, wherein the viewing area means is a playing surface of a game board.

3. The apparatus of claim 1, wherein the viewing area means is a monitor for displaying the plurality of spaces and the plurality of reference points.

4. The apparatus of claim 1 wherein the means for determining the space location of intersecting azimuths is a computer.

5. The apparatus of claim 1 wherein the encoder and decoder system comprises:

an encoder and decoder card system.

6. A game, comprising:

at least one viewing area means for defining an area of play;

the viewing area means having a plurality of spaces contained within a boundary and a plurality of reference points positioned on the viewing area means within the boundary;

wherein each of the plurality of spaces is capable of receiving and is configured to enable at least one playing piece to be operably positioned on any of the plurality of spaces on the viewing area means and to occupy at least one of the plurality of spaces;

azimuth indicator lines for use in selecting an azimuth; and azimuth means for determining a space location from two azimuths which intersect within the veiwing area means selected from a first azimuth emanating from a reference point at any orientation in angular degrees, from zero to three hundred sixty degrees and a second azimuth emanating from a second reference point at any orientation in angular degrees, from zero to three hundred sixty degrees, said means for determining a space location comprising an encoder and decoder system having first indicia corresponding to each of said plurality of reference points and to a plurality of angular degrees from zero to three hundred sixty degrees emanating from each of said reference points, wherein said first indicia corresponds to said point of intersection of two azimuths, said encoder and decoder system further having a second indicia corresponding to said plurality of spaces on said viewing area means, and a third indicia for converting the location of said point of intersection from said first indicia to said second indicia.

7. The game of claim 6 wherein the at least one viewing area means is at least one game board.

8. The game board of claim 7, wherein:

the plurality of reference points are fixed with respect to the game board.

9. The game of claim 6 wherein the at least one viewing area means further includes:

at least one grid.

10. The game of claim 9 wherein:

the at least one grid includes two identical grids each of which are positioned on a separate viewing area means.

11. The game of claim 9, wherein the at least one grid further includes:

vertical indicia associated with the columns and horizontal indicia associated with the rows of the at least one grid to provide addresses for the plurality of spaces on the; at least one grid of the viewing area means.

12. The game of claim 6 wherein the azimuth means further includes:

a plurality of encoder and decoder cards.

13. The game of claim 6 wherein the azimuth indicator lines are associated with protractor means having indicia for visually measuring an azimuth in degrees.

14. The game of claim 6 further including:

space locator means for randomly identifying any of the plurality of spaces of the viewing area means.

15. The game of claim 6 further including:

an instruction set defining at least one method of playing the game.

16. The game of claim 6, wherein the at least one playing piece comprises:

a plurality of playing pieces.

17. The game of claim 6, wherein:

the plurality of reference points are positioned by a player of the game.

18. The game of claim 17, wherein plurality of reference points comprises:

three reference points separated by at least one of the plurality of spaces.

19. The game of claim 18, further including:

an instruction set having an instruction requiring the placement of the plurality of reference points on the viewing area means separated by at least one of the plurality of spaces.

20. The game of claim 6, further including:

an azimuth means for determining the elevation of the at least one playing piece.

21. The game of claim 6 wherein:

the at least one viewing area means is at least one monitor.

22. The game of claim 6 wherein:

the azimuth means is a computer.

23. A method of playing a game using azimuths to locate any of a plurality of spaces, comprising the steps of:

providing at least one viewing area means having indicia associated with a plurality of spaces for determining a space location on the viewing area means;

providing at least one playing piece;

providing a plurality of reference points to the viewing area means;

positioning the at least one playing piece on the viewing area means;

providing means for determining azimuths on said viewing area means, said means for determining azimuths having means for converting selected angular degrees to the determining of azimuths accurately corresponding to selected angular degrees; and attempting to locate a space on said viewing area means by a) selecting a first reference point, selecting a first azimuth from a plurality of azimuths emanating from said selected first reference point by selecting any orientation in angular degrees, from zero degrees to three hundred sixty degrees, from said selected first reference point;

b) selecting a second reference point different from the first reference point from which the first azimuth emanates, selecting a second azimuth from a plurality of azimuths emanating from said selected second reference point by selecting any orientation in angular degrees, from zero degrees to three hundred sixty degrees, from said selected second reference point, wherein said first azimuth intersects with said second azimuth in hopes that said intersection corresponds to said space that is attempted to be located;

c) locating the actual intersection of said first and second azimuths by using said means for determining azimuths on said viewing area means to accurately determine said first and second azimuths on said viewing area means, and to accurately locate said intersection of said first and second azimuths;

d) determining whether said intersection corresponds to said space that is attempted to be located.

24. The method of claim 23, further including the step of: providing a spinner for randomly placing the at least one playing piece on the viewing area means.

25. The method of claim 23, further including the step of providing an encoder and a decoder card system.

26. The method of claim 23, further including the step of: providing a protractor having indicia to determine the first azimuth and the second azimuth in degrees.

27. The method of claim 23, further including the step of: selecting a third azimuth to determine the elevation of the at least one playing piece.

28. The method of claim 23, further including the step of: positioning a playing piece on the space of the viewing area means corresponding to the location of the intersection of the first and second azimuths.

29. The method of claim 23, further including the step of: providing a plurality of target playing pieces.

30. The method of claim 23, further including the step of: providing an instruction set defining at least one method of playing, the game.

31. The method of claim 23, further including the step of: providing a plurality of playing pieces for marking the point of intersection of the first and second azimuths.

32. The method of claim 23, further including the step of: providing an azimuth means for determining the elevation of the at least one playing piece.

33. The method of claim 23 further including the step of: providing a grid on the at least one viewing area means.

34. The method of claim 23, further including the step of: providing a computer for determining the point of intersection of the azimuths and the location of the corresponding space.

35. The method of claim 23, further including the step of: providing a monitor for displaying the at least one viewing area means.

* * * * *